US007112164B1

(12) United States Patent
Hoagland

(10) Patent No.: US 7,112,164 B1
(45) Date of Patent: Sep. 26, 2006

(54) WEIGHT LIFTING BAR APPARATUS

(76) Inventor: Jesse Hoagland, 333 Bellevue Ave., Apt. 12-B, Trenton, NJ (US) 08618

( * ) Notice: Subject to any disclaimer, the term of this patent is extended or adjusted under 35 U.S.C. 154(b) by 449 days.

(21) Appl. No.: 10/358,007

(22) Filed: Feb. 4, 2003

Related U.S. Application Data

(60) Provisional application No. 60/355,513, filed on Feb. 7, 2002.

(51) Int. Cl.
*A63B 21/072* (2006.01)

(52) U.S. Cl. ..... 482/106; 482/108

(58) Field of Classification Search ..... 482/104–108, 482/93, 94, 142
See application file for complete search history.

(56) References Cited

U.S. PATENT DOCUMENTS

| | | | | |
|---|---|---|---|---|
| 460,270 | A | 9/1891 | Somerby | |
| 2,508,567 | A | 5/1950 | Dymeck | |
| 2,722,419 | A | 11/1955 | Tarapczynski | |
| 2,986,314 | A | 5/1961 | Miller | |
| 3,468,534 | A | 9/1969 | Donato | |
| 3,679,107 | A | 7/1972 | Perrine | |
| 3,820,781 | A | 6/1974 | Kane | |
| 4,274,628 | A * | 6/1981 | Hoagland | 482/106 |
| 4,605,222 | A | 8/1986 | Shannon | |
| 4,623,146 | A | 11/1986 | Jackson | |
| 4,641,836 | A | 2/1987 | Clifton | |
| 4,789,154 | A | 12/1988 | Mattox | |
| 4,828,256 | A | 5/1989 | Lee | |
| 4,832,334 | A | 5/1989 | Mullen | |
| 4,863,158 | A * | 9/1989 | Tassone | 482/140 |
| 4,986,536 | A * | 1/1991 | Zane | 482/106 |
| 5,050,868 | A * | 9/1991 | Pearson | 482/94 |
| D320,636 | S | 10/1991 | Eckler | |
| D327,927 | S | 7/1992 | Foley | |
| 5,169,372 | A | 12/1992 | Tecco | |
| 5,221,244 | A | 6/1993 | Doss | |
| 5,248,287 | A | 9/1993 | Nicoletti | |
| D385,601 | S | 10/1997 | Uen | |
| 5,725,461 | A | 3/1998 | Bogard, II | |
| 6,010,439 | A * | 1/2000 | Bullard, Jr. | 482/106 |
| D425,151 | S * | 5/2000 | Landfair | D21/681 |
| 6,572,515 | B1 * | 6/2003 | De La Garza | 482/106 |
| 6,652,431 | B1 * | 11/2003 | Mattox | 482/139 |

* cited by examiner

*Primary Examiner*—Jerome W. Donnelly
(74) *Attorney, Agent, or Firm*—Sperry, Zoda & Kane

(57) ABSTRACT

A weight lifting bar apparatus usable with free weights which includes two weight bar sections which are angularly oriented upwardly with respect to the main central bar section to facilitate retaining of weights thereon during exercising. The apparatus may also include a yoke means comprising two individual yoke members having an inner concave downwardly facing section and an outer convex downwardly facing section to facilitate contour to against the shoulders and chest area of a user. The design may also include lateral brackets mounted on the weight lifting bar apparatus and defining mounting apertures thereadjacent to facilitate storage upon a weight rack. As many as four different gripping locations can be defined at various positions on the different configurations of the bar apparatus herewithin.

16 Claims, 4 Drawing Sheets

WEIGHT LIFTING BAR APPARATUS

This application claims priority rights of U.S. provisional patent application Ser. No. 60/355,513 filed Feb. 7, 2002 by Jesse Hoagland, the same inventor of the present application, which was filed on an "Improved Safety Squat Bar". This application is a continuation utility application thereof.

BACKGROUND OF THE INVENTION

1. Field of the Invention

The present invention deals with the field of weight lifting apparatus and in particular weight lifting apparatus designed for use in exercises making use of free weights. More particularly this apparatus is designed for use with exercises which bend the knees repeatedly. These are often referred to as deep knee bends and the user can increase the intensity of the exercise by increasing the amount of weight. This has the effect of increasing the stress on the user's shoulders which is necessary in order to intensity the exercise during such deep knee bends but which has the undesirable effect of creating excessive pressure on the back of a user. For this reason the present invention devises a means for further distributing that downward force on the user during such exercises and similar ones.

2. Description of the Prior Art

Numerous patents have been designed for the purposes of increasing the safety of free-weight barbell designs and especially those usable with deep knee bends such as U.S. Pat. No. 460,270 patented to L. B. Somerby on Sep. 29, 1891 on a "Dumb Bell"; and U.S. Pat. No. 2,508,567 patented May 23, 1950 to L. G. Dymeck on a "Bar Bell"; and U.S. Pat. No. 2,722,419 patented Nov. 1, 1955 to S. Tarapczynski and assigned one-half to Joseph Violante on an "Exercising Device"; and U.S. Pat. No. 2,986,314 patented May 30, 1961 to K. G. Miller on a "Carrying Yoke"; and U.S. Pat. No. 3,468,534 patented Sep. 23, 1969 to J. A. Donato on an "Exercise Bar Having Revolvable Arms"; and U.S. Pat. No. 3,679,107 patented to Walter E. Perrine on Jul. 25, 1972 on a "Lifting Yoke"; and U.S. Pat. No. 3,820,781 patented Jun. 28, 1974 to John E. Kane on a "Body Waist Exerciser"; and U.S. Pat. No. 4,274,628 patented Jun. 23, 1981 to Jesse Hoagland on a "Weight Lifting Bar Apparatus"; and U.S. Pat. No. 4,605,222 patented Aug. 12, 1986 to Gary L. Shannon on a "Weightlifting Exercise Bar"; and U.S. Pat. No. 4,623,146 patented Nov. 18, 1986 to Byron R. Jackson on an "Exercise Device"; and U.S. Pat. No. 4,641,836 patented Feb. 10, 1987 to Orville J. Clifton on a "Weight Lifting Apparatus For Exercising The Triceps"; and U.S. Pat. No. 4,789,154 patented Dec. 6, 1988 to Ernest M. Mattox on a "Neck Exercise Device"; and U.S. Pat. No. 4,828,256 patented May 9, 1989 to Suk Young Lee on a "Barbell"; and U.S. Pat. No. 4,832,334 patented May 23, 1989 to Karl I. Mullen on an "Apparatus For Use With Barbells"; and U.S. Pat. No. 4,863,158 patented Sep. 5, 1989 to Daniel R. Tassone on a "Sit-Up Exercise Aid"; and U.S. Pat. No. D320,636 patented Oct. 8, 1991 to Christopher W. Eckler on a "Weightlifting Bar"; and U.S. Pat. No. D327,927 patented Jul. 14, 1992 to Edward Foley on a "Sit-Up Exercise Bar"; and U.S. Pat. No. 5,169,372 patented Dec. 8, 1992 to Armand Tecco on an "Exercise Device"; and U.S. Pat. No. 5,221,244 patented Jun. 22, 1993 to Steven G. Doss on a "Bar Bell"; and U.S. Pat. No. 5,248,287 patented to Anthony Nicoletti on Sep. 28, 1993 on an "Exercise Device"; and U.S. Pat. No. D385,601 patented Oct. 28, 1997 to Samuel Uen and assigned to Chililon Enterprise Co., Ltd. on an "Exerciser"; and U.S. Pat. No. 5,725,461 patented Mar. 10, 1998 to Wayne M. Bogard, II on a "Weight Lifting Apparatus";

SUMMARY OF THE INVENTION

The present invention provides a weight lifting bar apparatus usable with free weights which includes a central bar section with a first and a second end. A supporting bar section extends longitudinally between the two ends and defines a central bar axis therealong which extends in a generally horizontally extending direction. The support bar section is positionable adjacent the body of a user and normally upon the shoulders of a user behind the head area to facilitate support of the weight lifting bar apparatus and free weights thereupon.

A first displacing bar section extends longitudinally outwardly from the first end of the central bar and defines a first displacing axis therealong. The first displacing axis is preferably oriented angularly with respect to the central bar axis. A second displacing bar section also extends longitudinally outwardly from the second end of the central bar and defines a second displacing axis therealong. The second displacing axis is preferably oriented angularly with respect to the central bar axis.

A first weight bar section is attached to the first displacing bar section at a position spatially disposed from the first end of the central bar section. This first weight bar section preferably defines a first weight bar axis extending therealong which is oriented longitudinally outwardly and upwardly from the first displacing bar section for the purpose of facilitating securement and retaining of free weights thereupon for exercising. A second weight bar section is also included attached to the second displacing bar section at a position spatially disposed from the second end of the central bar section. This second weight bar section defines a second weight bar axis extending therealong. The second weight bar section is preferably oriented with the second weight bar axis extending longitudinally outwardly and upwardly from the second displacing bar section.

A yoke may also be included secured to the supporting bar section and preferably including a first yoke member and a second yoke member. The first yoke member preferably extends outwardly and downwardly from the supporting bar section for the purpose of allowing retaining of the weight lifting bar apparatus upon the shoulders and chest of a user to facilitate comfort during exercising by more evenly distributing the weight of the bar and free weights. This first yoke member preferably includes an inner first arcuate yoke section positioned adjacent the supporting bar section which has a concave shape facing downwardly to facilitate engagement thereof and abutment thereof with respect to the upper shoulder areas of a user. Also the first yoke member preferably includes an outer first arcuate yoke section positioned more distant from the supporting bar section than the inner first arcuate yoke section which is shaped convexly facing downwardly for the purpose of facilitating engagement thereof with the upper frontal chest area of the user.

A second yoke member is also included in the yoke configuration preferably such that it extends outwardly and downwardly from the supporting bar section for facilitating retaining of the weight lifting bar apparatus on the shoulders and chest of a user for greater comfort. This second bar member is preferably spatially disposed from the first yoke member to define a head receiving zone therebetween for receiving the head of a user during exercising therewith. The second yoke member preferably also includes an inner second arcuate yoke section positioned adjacent the supporting bar section which is of a concave shape facing downwardly to facilitate engagement thereof with the upper shoulder area of a user. Also the second yoke member preferably includes a second outer arcuate yoke section positioned more distant from the supporting bar section than the inner second arcuate yoke section and having a convex shape facing downwardly to facilitate engagement thereof with the upper frontal chest areas of a user during exercising.

The first weight bar axis of the present invention is preferably oriented at an acute angle with respect to the central bar section preferably comprising less than ten degrees. Similarly the second weight bar section is oriented less than ten degrees with respect to the central bar axis also. Normally the first weight bar axis and the second weight bar axis will be mirror images of one another on both sides of the central bar axis.

The central bar section may also define a first central gripping zone thereon positioned adjacent the first end. Also the supporting bar section may define a second central gripping zone thereon positioned adjacent to the second end.

The weight lifting bar apparatus of the present invention may also include a first lateral bracket secured to the first weight bar section and defining a first mounting aperture therewithin to facilitate selective mounting of the weight bar apparatus upon adjacently positioned environmental structures for storage thereof or between exercises. Such environmental structures may include posts mounted in a wall or a weight lifting rack. Similarly a second lateral bracket may be secured to the second weight bar section such as to define a second mounting aperture therewithin to facilitate selective mounting of the weight lifting bar apparatus for storage or holding between exercises.

The first lateral bracket is preferably secured to the displacing bar section at a location adjacent the first end of the central bar and extends outwardly therefrom toward the first weight bar section for facilitating mounting of the weight lifting bar apparatus for storage. This first lateral bracket preferably includes a first transverse bracket member extending laterally outwardly from the first displacing bar section and a first vertical bracket member extending between the first transverse bracket member and the first weight bar section. The first transverse bracket member and the first vertical bracket member in cooperation with the first displacing bar section and the first weight bar section will preferably define the first mounting aperture therebetween.

In the preferred configuration a second lateral bracket will be secured to the second displacing bar section at a location adjacent the second end of the central bar and positioned extending outwardly therefrom toward the second bar section for facilitating mounting of the weight lifting bar apparatus between exercises or for storage such as upon a rack. The second lateral bracket may include a second transverse bracket member extending laterally outwardly from the second displacing bar section as well as a second vertical bracket member extending between the second transverse bracket member and the second weight bar section. The second transverse bracket member and the second vertical bracket member will, in cooperation with the second displacing bar section and the second weight bar section, define the second mounting aperture therebetween in the preferred configuration.

The weight lifting bar apparatus of the present invention may include a first primary gripping area defined on the first displacing bar section adjacent the first weight bar section and the second primary gripping area defined on the second displacing bar section adjacent the second weight bar section for the purpose of further facilitating holding of the weight lifting bar apparatus by a user.

The weight lifting bar apparatus may further include a first lower gripping area attached with respect to the first weight bar section adjacent the first displacing bar section as well as a second lower gripping area attached with respect to the second weight bar section adjacent the second displacing bar section to further facilitate holding of the weight lifting bar apparatus by a user. The first and second lower gripping members provide an alternative gripping location based upon the comfort of the user which can vary significantly responsive to the size of the user and the particular physiological differences.

The weight lifting bar apparatus can include a first strut secured to the first weight bar section adjacent the first displacing bar section which extends downwardly therefrom and which is attached to the first lower gripping member to facilitate affix securement thereof with respect to the weight lifting bar apparatus. Similarly a second strut may be included secured to the second weight bar section adjacent the second displacing bar section and extending downwardly therefrom and being attached to the second lower gripping member to facilitate affixed securement thereof with respect to the weight lifting bar apparatus. In the preferred configuration of the present invention the first lower gripping member and the second lower gripping member are both detachably securable with respect to the weight lifting bar apparatus of the present invention such as to be removed when designated as not being needed by a particular user.

In the preferred configuration the first lower gripping member will extend generally horizontally inwardly from the first strut to facilitate grasping thereof. Also the second lower gripping member will extend generally horizontally inwardly from the second strut toward the first lower gripping member to facilitate grasping thereof.

The weight lifting bar apparatus of the present invention may include various alternative gripping zones. Particularly defined is the first outer gripping zone secured to the first weight bar section between the first displacing bar section and the second lateral bracket and extending upwardly therefrom. Similarly a second outer gripping member may be secured to the second weight bar section between the second displacing bar section and the second lateral bracket and extending upwardly therefrom for the purpose of facilitating holding of the weight lifting bar by a user. The first outer gripping member and the second outer gripping member may also extend outwardly in an upward and rearward direction with respect to the first weight bar section and the second weight bar section, respectively.

As a further alternative gripping location the weight lifting bar apparatus of the present invention may define a first outermost gripping area defined on the first lateral bracket adjacent the first weight bar section thereof. Also defined may be a second outermost gripping area located on the second lateral bracket adjacent the second weight bar section thereof for the purpose of facilitating holding of the weight lifting bar apparatus by a user.

It is an object of the present invention to provide a weight lifting bar apparatus usable with free weights attached thereto which provides a free weight lifting squat bar apparatus which increases the amount of weight that a user can exercise when doing leg exercises such as deep knee bends.

It is an object of the present invention to provide a weight lifting bar apparatus usable with free weights attached thereto which is safer to use when performing any type of exercise relating to a user's legs with free weights suspended upon the shoulders of a user.

It is an object of the present invention to provide a weight lifting bar apparatus usable with free weights attached thereto which accurately allows the user to maintain a straight back and perform such exercises with perfect posture.

It is an object of the present invention to provide a weight lifting bar apparatus usable with free weights attached thereto which enables the user to hold the bar in the back of a user's head without requiring the bar to be grasped tightly by the user during exercises in an optional configuration.

It is an object of the present invention to provide a weight lifting bar apparatus usable with free weights attached thereto which prevents rolling of the bar off the back of a user's shoulder during deep knee bends.

It is an object of the present invention to provide a weight lifting bar apparatus usable with free weights attached thereto which minimizes danger to the joints and back of a user during exercising.

It is an object of the present invention to provide a weight lifting bar apparatus usable with free weights attached thereto which more evenly distributes the pressure of the weight of the bar and the free weights over the shoulders and chest of a user at all times during any free weight lifting exercise.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
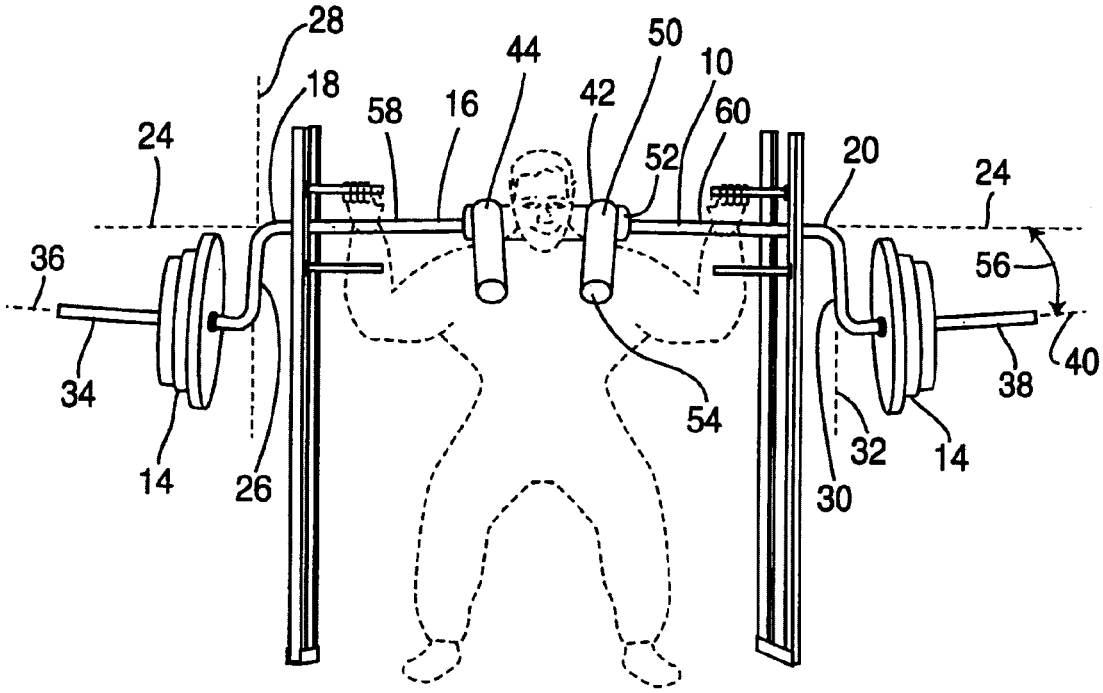
FIG. 1 is a front perspective illustration of the safety squat bar of the present invention shown in position upon a rack during exercising.
Figure 2:
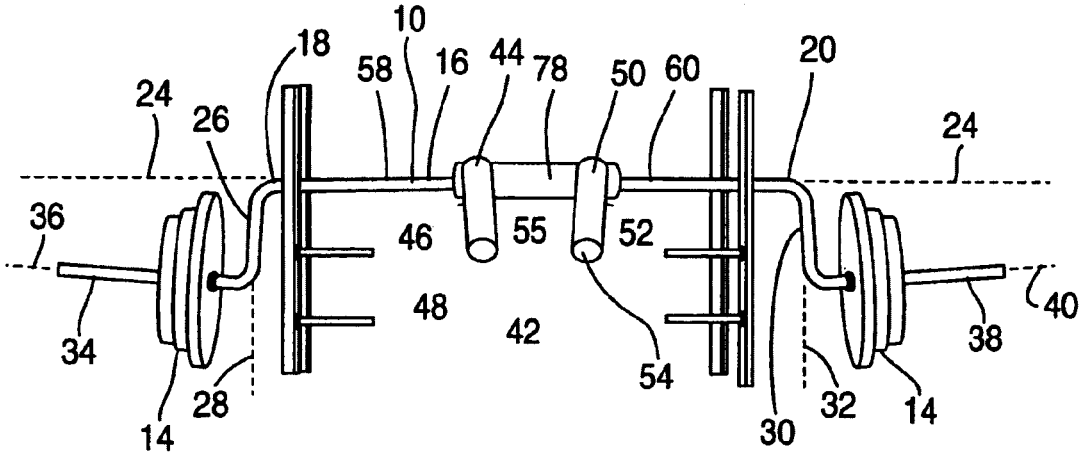
FIG. 2 is a front perspective illustration of an embodiment of the safety squat bar of the present invention.
Figure 3:
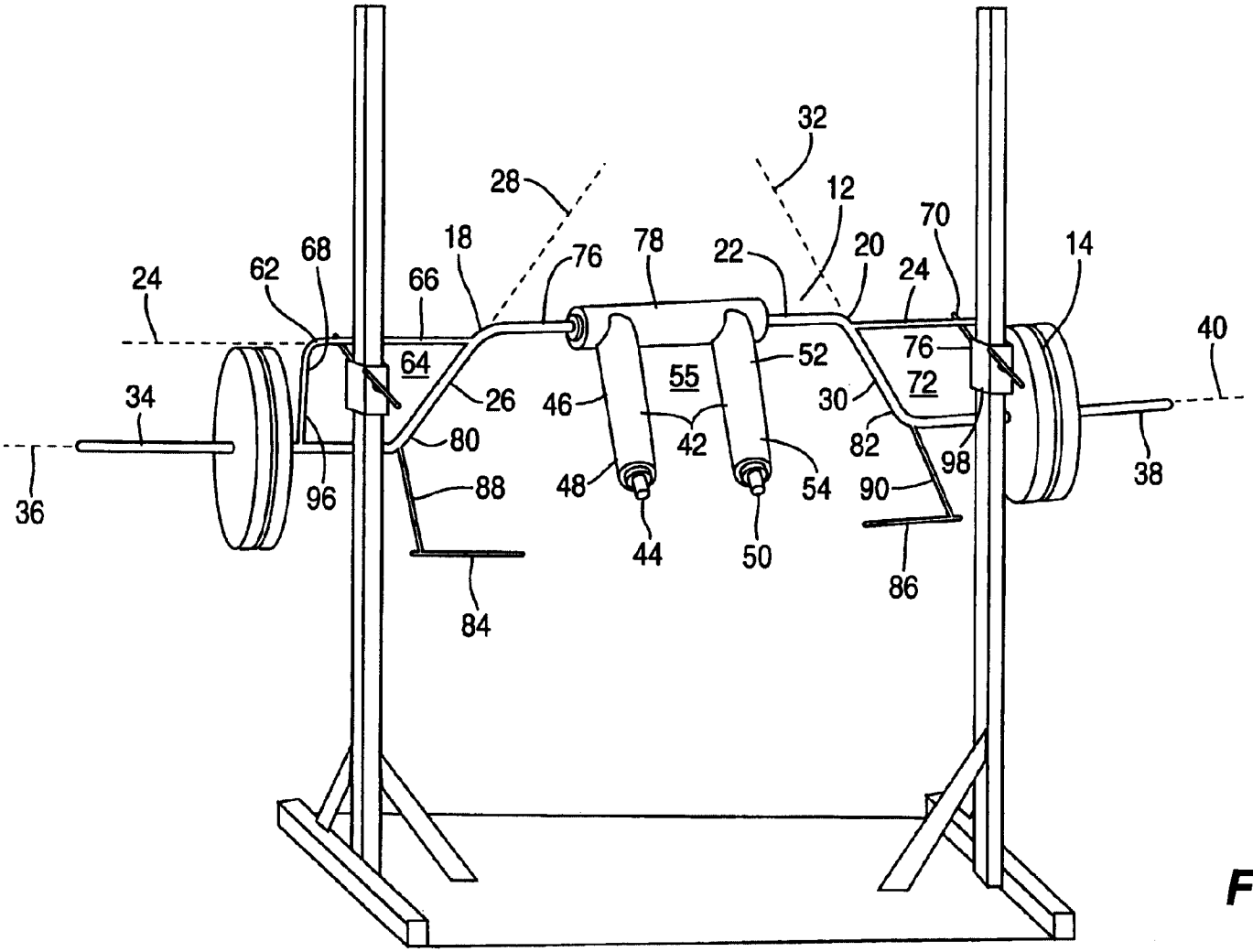
FIG. 3 is a front perspective illustration of an embodiment of the monster jam bar of the present invention.
Figure 4:
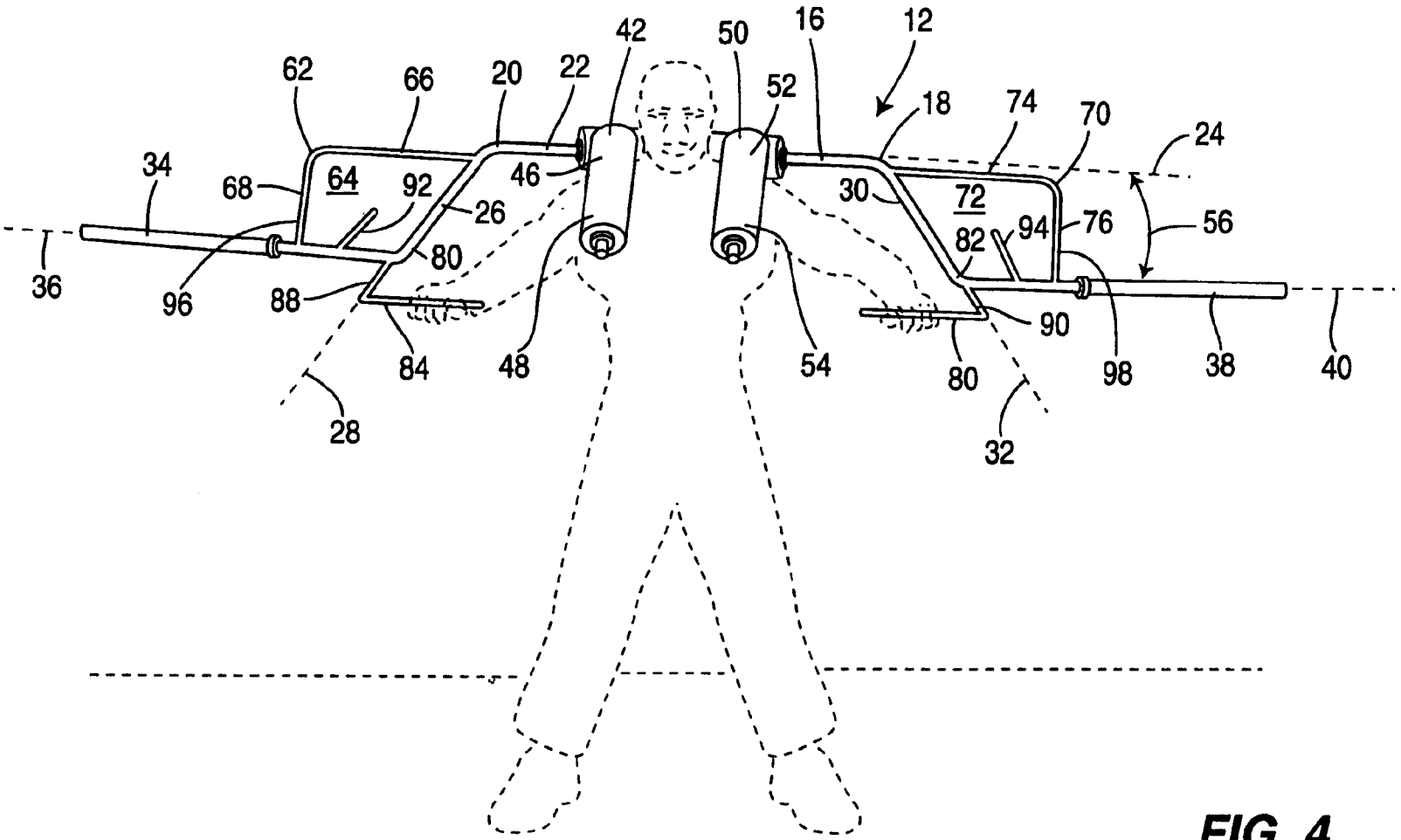
FIG. 4 is a front plan view of an embodiment of the monster jam bar of the present invention shown in use.
Figure 5:
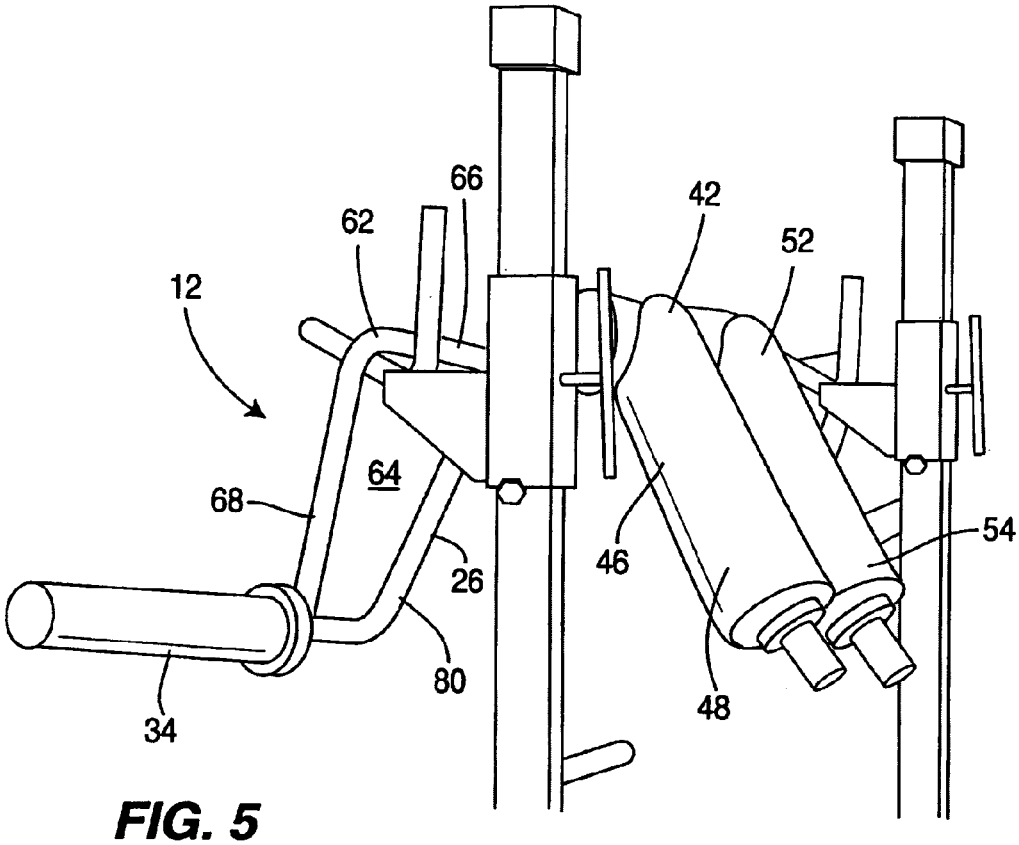
FIG. 5 is a side perspective illustration of an embodiment of the monster jam bar of the present invention.

The present invention provides a unique configuration for a weight lifting bar apparatus and is provided primarily in two embodiments. The first embodiment is the safety squat bar 10 shown in FIGS. 1 and 2. That bar is designed for holding free weights 14 at the outer extremities thereof and includes a central bar section 16. Central bar section 16 includes a supporting bar section 22 in the central location thereof including a first end 18 and a second end 20. The central bar section 16 extends approximately horizontally and defines a central bar axis 24.

The safety squat bar 10 includes a first displacing bar section 26 which extends outwardly from the central bar section 16 along a first displacing axis 28 defined thereby. Similarly a second displacing bar section 30 extends outwardly from the second end 20 of central bar 16 along a second displacing axis 32. Preferably the first displacing bar section 26 and the second displacing bar section 30 will be oriented at approximately 90 degrees relative to the central bar section 16. As such, the first displacing axis 28 and the second displacing axis 32 will be oriented approximately perpendicularly with respect to the central bar axis 24.

A first weight bar section 34 will be secured to the first displacing bar section 26 and extend outwardly therefrom for receiving free weights 14 secured thereonto. The first weight bar section 34 will preferably define a first weight bar axis 36 which preferably will form an acute angle of less than ten degrees relative to the central bar axis 24. This angle is shown as angle 56.

Similarly a second weight bar section 38 can extend outwardly from the second displacing bar section 30 in order to facilitate retaining of free weights 14 thereupon. This second weight bar section 38 will preferably define a second weight bar axis 40. Preferably second weight bar section 38 and the second weight bar axis 40 thereof will be oriented at an acute angle relative to the central bar section 16 which is preferably less than ten degrees and it is also defined as angle 56.

As an alternative configuration which is preferred, the safety squat bar 10 can include a yoke 42 including a first yoke member 44 extending forwardly from the central bar section 16. This first yoke member 44 of yoke 42 preferably will include an inner first arcuate yoke section 46 and an outer first arcuate yoke section 48. The inner first arcuate yoke section 46 is preferably shaped concave facing downwardly to mate with and extend over the upper portion of the shoulder of user. On the other hand the outer first arcuate yoke section 48 is preferably convex facing in the downwardly direction and is designed to mate with the upper chest area of a user and mate in the concave area between the lower portion of the shoulder and the beginning of the pectoral muscle and chest.

In a similar manner a second yoke member 50 may extend outwardly from the central bar section 16 laterally displaced from the first yoke member 44. This second yoke member preferably will include a second inner arcuate yoke section 52 which is preferably concave in a downwardly facing direction to facilitate mating thereof with the convex upper shoulder area of a user. The second yoke member 50 will also preferably include an outer second arcuate yoke section 54 which is preferably convex in a downwardly facing direction to mate with the generally concave shaped area of a user's body between the lower portion of the shoulder and the upper front chest area. The first yoke member 44 and the second yoke member 50 will be spaced apart from one another and define therebetween a head zone for receiving of the head of a user such that the two yoke members can extend down either side of the head along the upper shoulder area and in this manner more evenly distribute the weight exerted by the weight lifting bar upon the shoulders of the user.

The safety squat bar 10 may define a first central gripping zone 58 and a second central gripping zone 60 spaced apart from one another to facilitate gripping thereof for enhancing the exercising experience of movement of the safety squat bar 10.

The monster jam bar 12 is defined best in FIGS. 3–7 but has many similar characteristics to the safety squat bar 10.

The monster jam bar 12 can include a similar construction for the yoke 42 including the first yoke member 44 and the second yoke member 50. It also can include padding 78 extending over each of these yokes. This padding 78 can be used with the yoke 42 of the safety squat bar 10 or of the monster jam bar 12.

Thus the configuration of the first yoke member 44 and the second yoke member 50 of the yoke 42 is the same when included with the safety squat bar 10 as well as the monster jam bar 12. Also each bar can include a similar angular relationship between the first weight bar axis 36 of the first weight bar section 34 and the central bar section 16. Similarly these two bars both utilize the same relative angular relationship between the second weight bar section 38 and, in particular, the second weight bar axis 40 thereof relative to the central bar section 16. The angle is defined as angle 56 which is preferably defined to be less than ten degrees.

The monster jam bar 12 includes additional structural designs and can define a first lateral bracket 62 extending outwardly from the first displacing bar section 26. This first lateral bracket preferably defines a first mounting aperture means 64 therewithin. The first mounting aperture 64 is utilized for the purposes of facilitating mounting of the weight lifting bar apparatus relative to weight lifting bar holding racks or other similar environmental structure.

The first lateral bracket 62 preferably includes a first transverse bracket 66 extending approximately horizontally outwardly from the first displacing bar section 26 adjacent the first end 18 of the central bar section 16. A first vertical bracket 68 can extend upwardly from the first weight bar section 34 to the first transverse bracket 66. In this manner the first transverse bracket 66 and the first vertical bracket 68 will define two boundaries for the first mounting aperture 64. The other two boundaries which will define this aperture are provided by the first displacing bar section 26 and the first weight bar section 34.

In a similar manner a second lateral bracket 70 may be positioned adjacent to the second displacing bar section 30. Preferably second lateral bracket 70 includes a second transverse bracket member 74 extending approximately horizontally from the second displacing bar section 30 at a point thereof adjacent to the second end 20 of the central bar section 16. Also a second vertical bracket 76 can interconnect the second displacing bar section 30 with the second transverse bracket 74 and in this manner enclose and completely define the second mounting aperture 72.

Weight lifters can vary greatly in size, shape and capability. For this reason the present invention provides four different grasping locations for grasping the monster jam bar 12 to facilitate exercising therewith. The primary gripping means will be the first primary gripping area 80 which is preferably defined on the first displacing bar section 26 immediately adjacent to the first weight bar section 34 thereadjacent. Similarly a second primary gripping zone 82 can be defined on the second displacing bar section 30 in the area thereof immediately adjacent to the second weight bar section 38.

Figure 6:
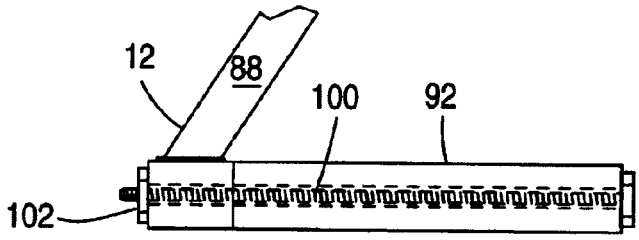
FIG. 6 is a cross-sectional view of the mechanism utilized for providing the removable lower gripping member.
Figure 7:
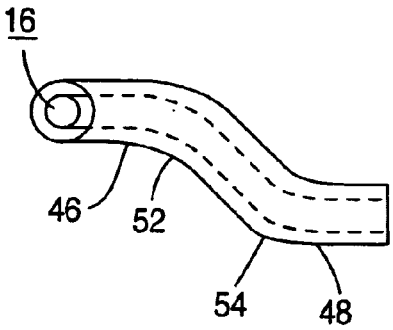
FIG. 7 is a side cross-sectional view of an embodiment of the yoke member of the present invention showing the inner concave arcuate yoke section and the outer convex arcuate yoke section.

Another alternative gripping location is the lower gripping members defined as the first lower gripping member 84 and the second lower gripping member 86. To facilitate mounting thereof a first strut 88 may be fixedly secured to the first weight bar section 34 in the area thereof adjacent to the first displacing bar section 26. This strut will provide a location for attachment of the first lower gripping means 84 thereto. Preferably first lower gripping means 84 will extend outwardly therefrom in an approximately horizontal direction. In the preferred embodiment of the present invention the first lower gripping member 84 is detachable from the first strut 88 as shown best in the configuration of FIG. 6. FIG. 6 shows the detachable nature of the first lower gripping means 84. With this configuration a bolt 100 extends through an aperture defined in the first strut 88 and defined in the first primary gripping member 80 and is attachable to a nut 102 for detachably securing the first primary gripping member 80 in place.

A second lower gripping member 86 is also preferably included in the apparatus of the present invention. A second strut 90 is fixedly secured to the second weight bar section 38 in the area thereof adjacent to the second displacing bar section 30. Second strut 90 provides an attachment location for the second lower gripping member 86. Preferably the second lower gripping member 86 will extend approximately horizontally outwardly therefrom. In the preferred configuration, also as shown in the same construction shown in FIG. 6, the second lower gripping member 86 can be detachably securable with respect to the second strut 90. Removal of the first lower gripping members 84 and the second lower gripping members 86 with respect to the respective struts provides a unique capability in the present invention since in some situations additional clearance is required for mounting or exercising with the monster jam bar.

Another alternative means of gripping the monster jam bar 12 is provided by the first outer gripping member 92. First outer gripping member 92 is attached to the first displacing bar section 26 and extends upwardly and rearwardly therefrom. The first outer gripping zone 92 preferably is secured to the first weight bar section 34 within the area thereof defined as the first mounting aperture 64.

In a similar manner a second outer gripping member 94 can be affixed to the second weight bar section 38 at a position thereof inboard from the second vertical bracket member 76 such that it extends upwardly and rearwardly therefrom. With this configuration the second outer gripping member 94 will be positioned within the second mounting aperture 72 and will extend rearwardly therefrom.

A further embodiment of the gripping means provided by the capability of the present invention is shown with the first outermost gripping zone 96. First outermost gripping zone 96 is defined on the first vertical bracket member 68. Similarly the second outermost gripping means 98 is defined on the second vertical bracket member 76. Thus the present invention provides the capability for a user holding the monster jam bar 12 with horizontal or vertically oriented gripping locations or gripping locations located partially horizontally and partially vertically such as the angular securement provided by the first and second primary gripping means 80 and 82. Also the distance of the gripping width can be varied significantly from the widest grip which is provided by the first and second outermost gripping members 96 and 98 to the innermost positions provided by the first and second primary gripping means 80 and 82 or the first and second lower gripping means 84 and 86.

The present invention provides a unique configuration for a weight lifting bar which is particularly usable for deep knee bend exercises performed with large amounts of weight positioned on the first weight bar section 34 and the second weight bar section 38. Such exercises normally require a significant amount of weight on the bar and can be excessively uncomfortable on the shoulders of a user. The present invention provides a way for overcoming this difficulty by equally distributing the weight over the shoulders of a user due to the unique yoke of the present invention as well as allowing the weights to be retained upon the weight receiving bars without the necessity of including collars due to the upwardly angled inclination thereof. Also the present invention provides multiple means for grasping of the safety squat bar 10 and the monster jam bar 12 and in this manner provides a more universally usable exercising device for use with free weights.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A weight lifting bar apparatus being usable with free weights attached thereto, said weight lifting bar apparatus comprising:

A. a central bar section including:

(1) a first end means;

(2) a second end means spatially disposed from said first end means;

(3) a supporting bar section extending longitudinally between said first end means and said second end means and defining a central bar axis therealong extending generally horizontally, said supporting bar section being positionable adjacent to the body of a user to facilitate support of the weight lifting bar apparatus thereupon;

B. a first displacing bar section extending longitudinally outwardly from said first end means of said central bar section and defining a first displacing axis therealong, said first displacing axis being oriented angularly with respect to the central bar axis;

C. a second displacing bar section extending longitudinally outwardly from said second end means of said central bar section and defining a second displacing axis therealong, said second displacing axis being oriented angularly with respect to the central bar axis;

D. a first weight bar section attached to said first displacing bar section at a position spatially disposed from said first end means of said central bar section, said first weight bar section defining a first weight bar axis extending therealong, said first weight bar section being oriented with said first weight bar axis extending longitudinally outwardly and upwardly from said first displacing bar section to facilitate securement and retaining of free weights thereupon for enhancing exercising with the weight lifting bar apparatus; and E. a second weight bar section attached to said second displacing bar section at a position spatially disposed from said second end means of said central bar section, said second weight bar section defining a second weight bar axis extending therealong, said second weight bar section being oriented with said second weight bar axis extending longitudinally outwardly and upwardly from said second displacing bar section to facilitate securement and retaining of free weights thereupon for enhancing exercising with the weight lifting bar apparatus;

F. a first lateral bracket means secured to said first weight bar section and defining a first mounting aperture means therewithin to facilitate selective mounting of said weight lifting bar apparatus upon adjacently positioned environmental structures for storage thereof;

G. a second lateral bracket means secured to said second weight bar section and defining a second mounting aperture means therewithin to facilitate selective mounting of said weight lifting bar apparatus upon adjacently positioned environmental structures for storage thereof;

H. a yoke means secured to said supporting bar section and including:

(1) a first yoke member extending outwardly and downwardly from said supporting bar section to facilitate retaining of the weight lifting bar apparatus upon the shoulders and chest of a user to facilitate comfort during exercising by more evenly distributing the weight thereof during exercising, said first yoke member including;

(a) an inner first arcuate yoke section positioned adjacent said supporting bar section and being shaped concavely facing downwardly to facilitate engagement thereof with the upper shoulder areas of a user during exercising;

(b) an outer first arcuate yoke section positioned more distant from said supporting bar section than said inner first arcuate yoke section and being shaped convexly facing downwardly to facilitate engagement thereof with the upper frontal chest areas of a user during exercising;

(2) a second yoke member extending outwardly and downwardly from said supporting bar section to facilitate retaining of the weight lifting bar apparatus upon the shoulders and chest of a user to facilitate comfort during exercising by more evenly distributing the weight thereof during exercising, said second yoke member being positioned spatially disposed from said first yoke member to define a head receiving zone therebetween for receiving the head of a user during exercising therewith, said second yoke member including:

(a) an inner second arcuate yoke section positioned adjacent said supporting bar section and being shaped concavely facing downwardly to facilitate engagement thereof with the upper shoulder areas of a user during exercising;

(b) an outer second arcuate yoke section positioned more distant from said supporting bar section than said inner second arcuate yoke section and being shaped convexly facing downwardly to facilitate engagement thereof with the upper frontal chest areas of a user during exercising.

2. A weight lifting bar apparatus as defined in claim 1 wherein said first lateral bracket means is secured to said first displacing bar section at a location adjacent said first end means of said central bar section and extends outwardly therefrom toward said first weight bar section to facilitate mounting of the weight lifting bar apparatus for storage.

3. A weight lifting bar apparatus as defined in claim 1 wherein said first lateral bracket means includes:

A. a first transverse bracket member extending laterally outwardly from said first displacing bar section; and B. a first vertical bracket member extending between said first transverse bracket member and said first weight bar section.

4. A weight lifting bar apparatus as defined in claim 3 wherein said first transverse bracket member and said first vertical bracket member and said first displacing bar section and said first weight bar section define said first mounting aperture means therebetween.

5. A weight lifting bar apparatus as defined in claim 1 wherein said second lateral bracket means is secured to said second displacing bar section at a location adjacent said second end means of said central bar section and extends outwardly therefrom toward said second weight bar section to facilitate mounting of the weight lifting bar apparatus for storage.

6. A weight lifting bar apparatus as defined in claim 1 wherein said second lateral bracket means includes:

A. a second transverse bracket member extending laterally outwardly from said second displacing bar section; and B. a second vertical bracket member extending between said second transverse bracket member and said second weight bar section.

7. A weight lifting bar apparatus as defined in claim 6 wherein said second transverse bracket member and said second vertical bracket member and said second displacing bar section and said second weight bar section define said second mounting aperture means therebetween.

8. A weight lifting bar apparatus as defined in claim 1 further comprising:

A. a first primary gripping means defined on said first displacing bar section adjacent said first weight bar section to facilitate holding of the weight lifting bar apparatus by a user for exercising therewith; and B. a second primary gripping means defined on said second displacing bar section adjacent said second weight bar section to further facilitate holding of the weight lifting bar apparatus by a user for exercising therewith.

9. A weight lifting bar apparatus as defined in claim 1 further comprising:

A. a first lower gripping means attached with respect to said first weight bar section adjacent said first displacing bar section to facilitate holding of the weight lifting bar apparatus by a user for exercising therewith; and B. a second lower gripping means attached with respect to said second weight bar section adjacent said second displacing bar section to further facilitate holding of the weight lifting bar apparatus by a user for exercising therewith.

10. A weight lifting bar apparatus as defined in claim 9 further comprising:

A. a first strut means secured to said first weight bar section adjacent said first displacing bar section and extending downwardly therefrom and being attached to said first lower gripping means to facilitate affixed securement thereof with respect to the weight lifting bar apparatus; and B. a second strut means secured to said second weight bar section adjacent said second displacing bar section and extending downwardly therefrom and being attached to said second lower gripping means to facilitate affixed securement thereof with respect to the weight lifting bar apparatus.

11. A weight lifting bar apparatus as defined in claim 10 wherein said first lower gripping means extends generally horizontally inwardly from said first strut means to facilitate grasping thereof and wherein said second lower gripping means extends generally horizontally inwardly from said second strut means toward said first lower gripping means to facilitate grasping thereof.

12. A weight lifting bar apparatus as defined in claim 11 wherein said first lower gripping means and said second lower gripping means are detachably secured to said first weight bar section and said second weight bar section, respectively, to facilitate use and storage of the weight lifting bar apparatus without said first lower gripping means and said second lower gripping means.

13. A weight lifting bar apparatus as defined in claim 1 further comprising:

A. a first outer gripping means secured to said first weight bar section between said first displacing bar section and said first lateral bracket means and extending upwardly therefrom to facilitate holding of the weight lifting bar apparatus by a user; and B. a second outer gripping means secured to said second weight bar section between said second displacing bar section and said second lateral bracket means and extending upwardly therefrom to facilitate holding of the weight lifting bar apparatus by a user.

14. A weight lifting bar apparatus as defined in claim 13 wherein said first outer gripping means and said second outer gripping means extend outwardly in an upward and rearward inclination with respect to said first weight bar section and said second weight bar section, respectively.

15. A weight lifting bar apparatus as defined in claim 1 further comprising:

A. a first outermost gripping means defined on said first lateral bracket means adjacent said first weight bar section thereof to facilitate holding of the weight lifting bar apparatus by a user; and B. a second outermost gripping means defined on said second lateral bracket means adjacent said second weight bar section thereof to facilitate holding of the weight lifting bar apparatus by a user.

16. A weight lifting bar apparatus as defined in claim 1 wherein said first weight bar axis is oriented at an acute angle of less than ten degrees with respect to said central bar axis and wherein said second weight bar axis is oriented at an acute angle of less than ten degrees with respect to said central bar axis.

* * * * *